United States Patent [19]

Fondronnier et al.

[11] 4,262,566

[45] Apr. 21, 1981

[54] DEVICE FOR CONTINUOUSLY AND ROTATABLY CUTTING A SHEET TRANSVERSELY WITH RESPECT TO ITS DIRECTION OF ADVANCE

[75] Inventors: Jacques Fondronnier, Creteil Mont Mesly; Jean Guillerm, Saint Maur, both of France

[73] Assignee: Centre Technique du Bois, Paris, France

[21] Appl. No.: 5,805

[22] Filed: Jan. 23, 1979

[30] Foreign Application Priority Data

Jan. 23, 1978 [FR] France ..... 78 01810

[51] Int. Cl.[3] ..... B27M 3/08; B27L 5/08

[52] U.S. Cl. ..... 83/116; 83/331; 83/349; 83/304; 83/42

[58] Field of Search ..... 83/116, 331, 304, 349, 83/42, 343, 346; 144/209

[56] References Cited

U.S. PATENT DOCUMENTS

| | | | |
|---|---|---|---|
| 807,420 | 12/1905 | Copland | 83/331 |
| 1,007,721 | 11/1911 | Meyer | 83/116 |
| 1,304,034 | 5/1919 | Edwards | 83/304 |
| 2,761,513 | 9/1956 | Stram | 83/304 X |
| 3,555,947 | 1/1971 | Fram | 83/116 |
| 3,945,280 | 3/1976 | Roncato | 83/116 |

*Primary Examiner*—Donald R. Schran

*Attorney, Agent, or Firm*—DeLio and Montgomery

[57] ABSTRACT

The present invention relates to a process and device for continuously and rotatably cutting a sheet transversely with respect to its direction of advance, wherein the device comprises a rotor provided with cutters and mounted to rotate about an axis eccentric with respect to that of a squirrel cage surrounding this rotor, the bars of the cage defining slots for the passage of the cutters as far as a flexible belt resting on an anvil member and wound on cylinders for driving the sheet to be cut. This device is particularly applicable to the cutting of laths from a sheet of wood as said latter is peeled, for the manufacture of packing cases or the like.

16 Claims, 4 Drawing Figures

DEVICE FOR CONTINUOUSLY AND ROTATABLY CUTTING A SHEET TRANSVERSELY WITH RESPECT TO ITS DIRECTION OF ADVANCE

The present invention relates to a process for continuously and rotatably cutting a sheet of any material, preferably peeled wood, transversely with respect to its direction of advance.

Such a process, called "back roll", is known, which consists in pressing against a trunk of wood, upstream and generally diametrically opposite the wood-peeling blade, the cylinder of the cutting machine provided with longitudinal cutters. The trunk of wood drives the cylinder positively in rotation by reason of the penetration of the cutters in the wood.

The major drawback of this known method results from the fact that the sections of the cutting edge of each cutter and of the incision made in the wood thereby, are not conjugate in an involute of circle and consequently cannot "mesh" without producing a considerable increase in the cutting force and without bringing about serious waste or defects. Among the latter is observed a rapid blunting of the cutting edges, requiring frequent sharpening and adjustments of the cutters; also observed are phenomena of compression of the wood, tearing of fibres, shredding.

The edges of the strips or plates thus cut from the peeled wood are always irregular, chopped up and not perpendicular to the surface.

To ensure the complete separation of the successive strips, the projection of the cutters must be greater than the peeled thickness since it is an incision by compression and not a clear cut. Consequently, incipient slots may be observed in the following layer of peeled wood.

In addition, the shocks consecutive to cutting are frequent and very intense, this being prejudicial to the quality of the work and to the state of conservation of the peeling apparatus.

It is an object of the present invention to remedy these drawbacks by proposing a method according to which the peeled sheet is incurved to envelop the cutting rotor.

The rotary cutting device carrying out this process comprises a rotor provided with longitudinal cutters adapted to penetrate by pressure into the sheet to be cut transversely; in accordance with the invention, the device also comprises:

- a squirrel cage surrounding the cutting rotor and presenting longitudinal bars which define, in two's slots for the passage of the cutters of this rotor, the axes of rotation of said rotor and said cage being eccentric which respect to each other in order to effect a meshing of said cutters with said bars, by the interior,
- an endless belt constituted by a cutting elastomer, wound a round two cylinders and applied by one of its sides against the outer envelope of the edges of the cutters of the rotor,
- a rigid, concave anvil member extending substantially concentrically with respect to the squirrel cage and disposed there-opposite with respect to the endless belt which it is adapted to support during its advance,
- a drive device adapted to drive in rotation, indifferently, one of the belt-carrier cylinders, the cutter-carrying rotor or the squirrel cage,

- and a presser device tending to bring one of the squirrel cage and the anvil member closer to the other, indifferently, to grip therebetween the sheet to be cut, the distance of this anvil member to the axis of the rotor remaining constant.

According to a particularly advantageous embodiment, a fixed frame supports the anvil member, the belt-carrier cylinders and the cutter-carrying rotor, whilst a mobile chassis supporting the squirrel cage and through which said rotor passes, is guided, preferably by pivoting, relatively to the fixed frame so that the mobile equipment thus constituted forms, at least by its own gravity, the presser device which applies, via said cage, the sheet to be cut against the belt and said latter against the anvil member.

This process and the device of the invention enable a radial and clean cut to be made. It is effected during a much longer period of time (10 to 20 times greater) than with the back roll, this leaving the wood the time to be compressed tangentially, upon passage of the cutting edge of a cutter, between two radial compression surfaces, this process can obviously not be observed with a back-roll "shock" which leads to splitting of fibres.

According to the invention, the speed of penetration of the cutting edge of a cutter in the wood decreases progressively from the inner skin to the outer skin where it becomes zero, this enabling an uncontrolled splitting of the wood to be avoided.

According to the invention, cutting is carried out without noise due to the synchronisation and progressiveness of the movements.

According to the invention, the design of the device enables strips to be cut whatever the thickness of the peeled wood and enables the width of these strips to be varied by means of a simple adjustment, whilst the so-called "back roll" process requires the use of as many cylinders as thicknesses and widths of wood to be cut.

The invention will be more readily understood on reading the following description with reference to the accompanying drawings, in which.

Figure 1:
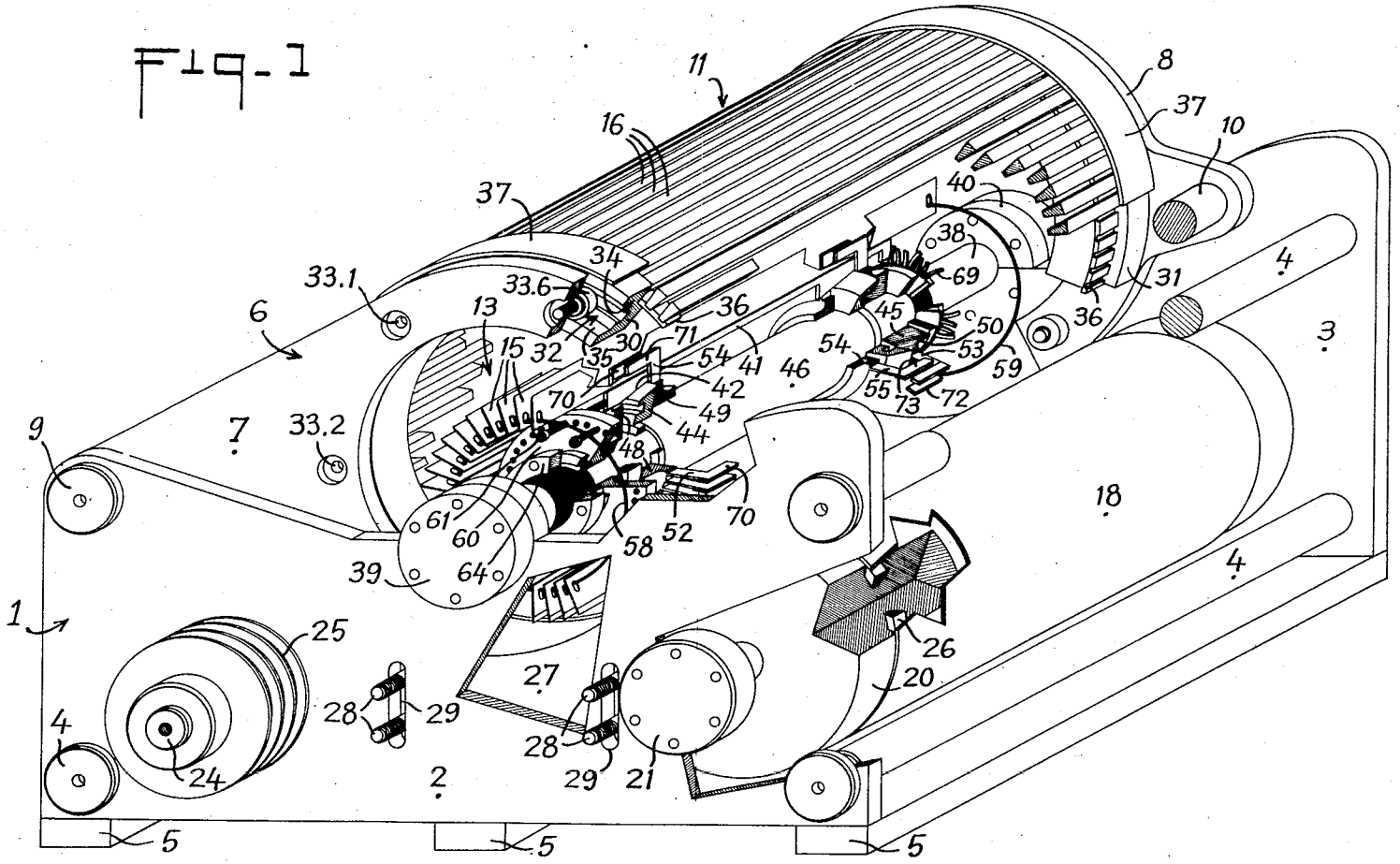
FIG. 1 is a perspective view, with parts torn away, showing the device according to the invention.

Referring now to the drawings, FIG. 1 clearly shows the device according to the invention which presents a fixed frame 1 constituted by two side members 2, 3 rigidly connected together by means of cross-pieces 4 and bed-plates 5.

It also presents a mobile chassis 6 constituted by two perforated plates 7, 8 mounted to pivot against the side members 2, 3 by means of pins 9, these plates being fast with each other, particularly via a front cross-piece 10.

Figure 2:
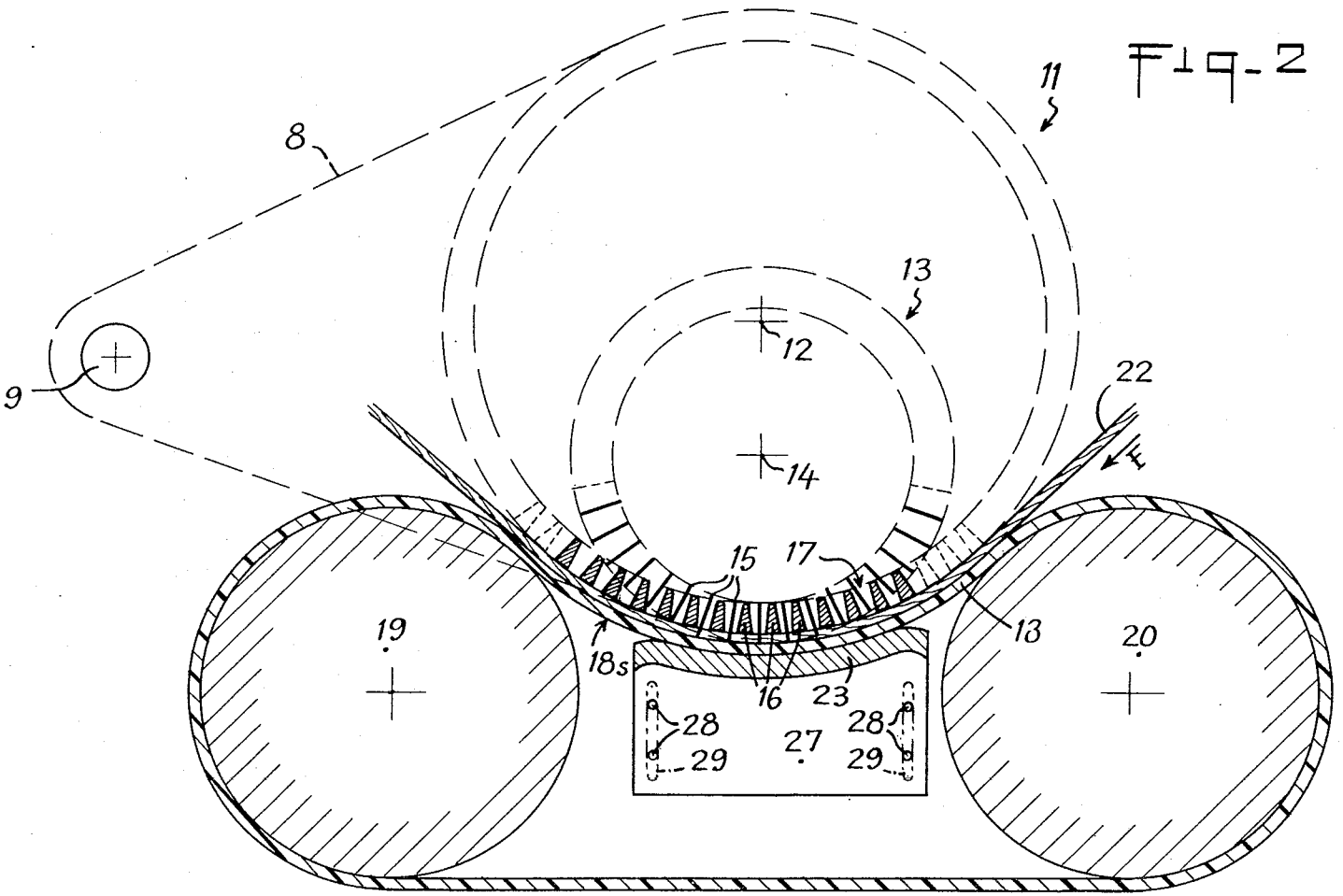
FIG. 2 is a partial, schematic transverse section of this device.

As shown schematically in FIG. 2, the device comprises:

- a squirrel cage 11 extending between the plates 7, 8 of the pivoting chassis and mounted to rotate, relatively to said plates, about a geometrical axis 12,
- a rotor 13 extending between the side members 2, 3 of the fixed frame and mounted to rotate, relatively thereto, about a geometrical axis 14 parallel to the preceding one, The rotor 13 is made fast with a plurality of cutters 15 and the cage 11 with a plurality of bars 16 separated from one another by slots 17. This rotor extends inside the said cage and its axis of rotation 14 is eccentric downwardly with respect to the axis of rotation 12 of said cage, so that, in the lower part, the cutters 15 pass through the slots 17 and mesh with the bars 16. In the example shown, the rotor 13 presents 42 equidistant cutters of 25 mm which is the width of the strips to be cut up and the cage presents 70 equidistant bars of the same size.

The rotary cutting device also comprises:

an endless belt 18 constituted by an elastomer of the same composition and constitution as the one used for the so-called "rubber" cutting tools; this belt is wound around two cylinders 19 and 20 extending between the side members 2 and 3 of the fixed frame parallel to the axes 12 and 14; the cylinders are mounted idly in bearings 21 (FIG. 1) of these side members; the bearings are disposed so that the upper side 18*s* of the belt is in contact with the cutting edges of the cutters 15 projecting from the bars 16 and is incurved concentrically with respect to the squirrel cage 11 (FIG. 2), the sheet to be cut, 22, being interposed, during its advance in the direction of arrow F, between this cage and the upper incurved side 18*s* of the belt;

a rigid concave anvil member 23 fast with the side members 2, 3 of the fixed frame and extending, below the side 18*s* of the belt, substantially concentrically with respect to the squirrel cage 11; this anvil supports the belt during the advance movement of the sheet 22 and forms a reaction element when the cutters 15 effect the rotary cutting;

a drive device adapted to rotate, indifferently, the cutter-carrying rotor 13, the squirrel cage 11 or one of the belt-carrier cylinders 19, 20; in the example illustrated in FIG. 1 and which corresponds to this latter case, the end journal 24 of the cylinder 19 projecting from the side member 2 is coupled with a multiple-groove pulley 25 on which are wound-drive belts (not shown); this cylinder 19 causes the belt 18 to advance, which takes along the sheet 22 to be cut, in which the cutters 15 penetrate, the penetration of the cutters, the friction of the bars 16 and their mesh therewith provoking the synchronous rotation of the rotor 13 and of the squirrel cage 11, a presser device tending to bring one of the anvil member 23 and the squirrel cage 11 closer to the other, indifferently, to grip therebetween the sheet 22 to be cut, the distance of this anvil member to the axis 14 of the rotor 13 having, however, to remain constant so that the cutting edges of the cutters 15 are always in contact with the b elt 18; in the example shown, the presser device proceeds by gravity and is the mobile equipment itself, as constituted by the pivoting chassis 6, the squirrel cage 11 and the rotor 13; of course, the presser device may also comprise, to assist the action of gravity, at least one mechanical member (spring, counterweight or the like) or pneumatic or hydraulic member coupled to the pivoting chassis 6.

It is clear that the sheet 22 is really taken by the device; it is pressed by the squirrel cage 11 against the belt 18, itself applied against the anvil member 23, and, at this spot, the cutters 15 of the rotor 13 penetrate radially, progressively and less and less quickly into said sheet which they cut into strips with clean edges when they come into contact with the belt.

As shown in FIG. 1, the belt 18 is flat and presents, on its face which is in contact with cylinders 19, 20 two projecting beads 26 of trapezoidal section penetrating, during the advance movement, into grooves of like section made in said cylinders; an excellent guiding is thus obtained.

Furthermore, the anvil member 23 is preferably adjustable; to this end, it is fast with descending end plates 27 (FIGS. 1 and 2) provided with studs 28 passing through elongated holes 29 in the side members 2, 3 of the fixed frame 1. Thus, it is possible to adjust its level and orientation and then to block it by tightening the nuts of the studs.

It may be advantageous to make the squirrel cage 11 as shown in FIG. 1. The cage comprises two end rings 30 and 31 disposed symmetrically with respect to each other near the perforated plates 7 and 8, these rings being made fast with the bars.

As can be seen more clearly for ring 30, said latter presents a front annular groove 32 for the housing of guide rollers 33.1 to 33.6. The groove 32 is defined by two bearing races 34 and 35 concentric with respect to the axis 12 and radially distant by a length greater than the diameter of the rollers. These rollers are mounted idly on the perforated plate 7 of the pivoting chassis and in projection on the inner face of said plate. The even rollers 33.2, 33.4 and 33.6 bear against the outer bearing race 34 and are separated from the inner bearing race 35, whilst the odd rollers 33.1, 33.3 and 33.5 bear against this inner bearing race 35 and are separated from the outer race 34. The above-described arrangement with respect to the ring 30 is, of course, symmetrical for the ring 31. An excellent guiding in rotation of the cage 11 is thus obtained by the periphery thereof.

To allow their assembly, the bars 16 are interposed, at each of their ends, between an inner notched collar 36 fixed on a shoulder track of the corresponding ring 30 or 31, on the one hand, and an outer collar 37 fixed on the top of the ring in question. In order to have access to inside the squirrel cage 11, to carry out any desired operation on the rotor 13, the assembly constituted by the bars 16 and the collars 36, 37 is divided into two halves so that the half-shells thus obtained may be added or dismantled independently of each other on the rings 30 and 31.

Figure 3:
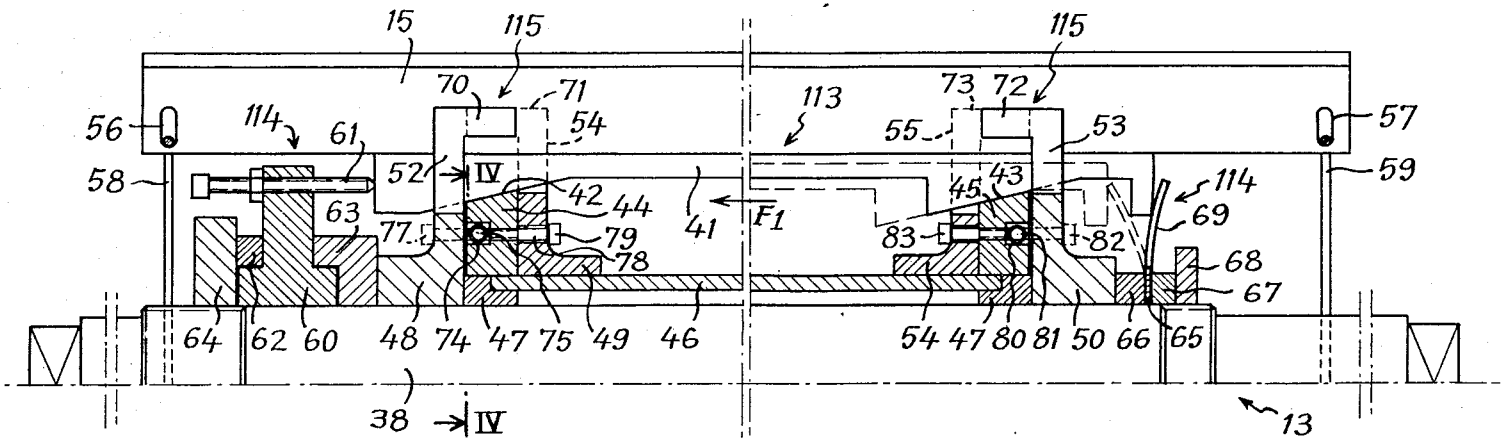
FIG. 3 is a longitudinal axial section of the rotor with cutters.
Figure 4:
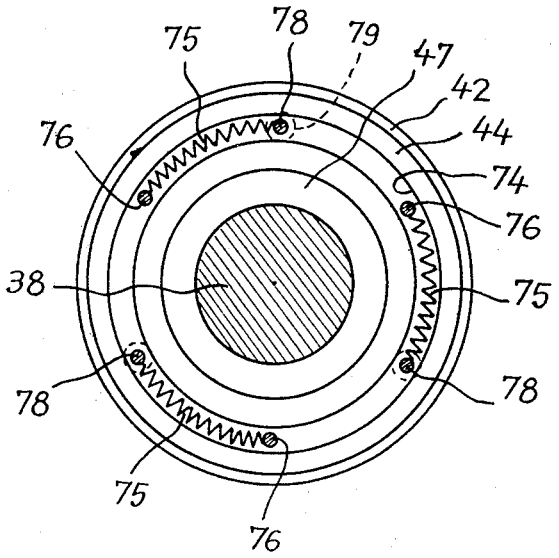
FIG. 4 is a partial transverse section taken along line IV—IV of FIG. 3.

As is now clear from FIGS. 1, 3 and 4, the rotor 13 comprises a shaft 38 mounted to rotate, through the openings of the plates 7, 8 of the pivoting chassis 6, in end bearings 39, 40 centred on the axis 14 and fixed on the side members 2, 3 of the fixed frame 1.

Of course, the cutters 15 may be fixed definitively in a core fast with the shaft 38.

However, it seems more advantageous to associate with the rotor 13 a selector device 113 allowing the width of the strips cut from the sheet 22 to be cut, to be adjusted; this selector device, described hereinafter, contributes to retracting certain cutters and to maintaining the remaining cutters in cutting position.

Thus, in the example previously chosen and shown:

by maintaining 42 cutters, 42 laths of 25 mm are cut out per revolution;

by retracting 1 cutter out of 2, which enables 21 cutters to be maintained in place, 21 laths of 50 mm are cut out per revolution by retracting 2 cutters out of 3, which enables 14 cutters to be maintained in place, 14 laths of 75 mm are cut out per revolution by retracting 5 cutters out of 6, which enables 7 cutters to be maintained in place, 7 laths of 150 mm are cut out per revolution by retracting 6 cutters out of 7, which enables 6 cutters to be maintained in place, 6 portions of 175 mm are cut out per revolution.

by retracting 13 cutters out of 14, which enables 3 cutters to be maintained in place, 3 portions of 350 mm are cut out per revolution.

by retracting 20 cutters out of 21, which enables 2 cutters to be maintained in place, 2 portions of 525 mm are cut out per revolution.

by retracting 41 cutters out of 42, which enables 1 cutter to be maintained in place, 1 portion of 1050 mm is cut out per revolution.

In the selector device 113 (FIG. 3), each cutter 15 rests on an adjustment slide 41 presenting, near its ends, inclined ramps 42 and 43 parallel to each other. The incline ramps 42 of all the slides cooperate with a conical ring 44 of the same inclination and, also, the inclined ramps 43 of all the slides cooperate with a conical ring 45. The rings 44 and 45 are rigidly connected together by a tubular shaft 46 mounted idly, by means of bearings 47, about the central shaft 38 of the rotor.

Two star-shaped rings 48 and 49, respectively fast with the shafts 38 and 46 are disposed on either side of the conical ring 44; similarly, two star-shaped rings 50 and 51, respectively fast with shafts 38 and 46, are disposed on either side of the conical ring 45.

The radial arms 52 and 53 of the rings 48 and 50 of the central shaft 38 are located opposite; similarly, the radial arms 54 and 55 of the rings 49 and 51 of the tubular shaft 46 are located opposite, but are bisectrices of the free spaces separating the preceding arms 52 and 53. Consequently, an arm 52 and the conjugate arm 53 form with a contiguous arm 54 and the conjugate arm 55, two aligned radial notches in which are guided a cutter 15 resting on a slide 41 and this slide resting, by its inclined ramps 42, 43, on the conical rings 44, 45.

These mutual supports: cutter on slide and slide on ring, are obtained by means of elastic members tending to draw the cutters towards the axis of rotation 14. In the example shown, each cutter defines at its ends, holes 56 and 57; in the holes 56 of all the cutters there is engaged a spring ring 58 of which the free ends overlap and which tends, on retracting, to draw each cutter towards the centre; similarly, in the holes 57 of all the cutters, there is engaged a retractile spring ring 59.

Each slide 41 is connected to a servo-control device 114 in longitudinal position which enables the slide in question to occupy:

either the "active position" represented in solid lines (FIG. 3) in which the inclined ramps 42, 43 have risen along the conical rings 44, 45 and which corresponds to the expanded position of cut of the conjugate cutter 15, or the "passive position" shown in broken lines, in which the inclined ramps 42, 43 have descended along the conical rings 44, 45 and which corresponds to the retracted position of the conjugate cutter 15.

This servo-control device 114 comprises, on the side towards which the slides 41 tend to move (arrow F1), when the inclined ramps 42, 43 descend along the rings 44, 45, a ring 60 wedged angularly, for example by keying, on the central shaft 38. This ring is provided, opposite each slide 41, with a screw 61 forming an adjustable stop. If certain screws 61 occupy the position shown in solid lines, the corresponding slides 41 are in "active position" and the conjugate cutters 15 in "cutting position". The other screws 61 are then moved back in the direction of arrow F1 and, consequently, the corresponding slides 41 may occupy the "passive" position shown in broken lines and the conjugate cutters 15 the "retracted position".

Of course, the ring 60 presents as many projecting stops 61—the others being retracted—as the rotary cutting device must comprise active cutters for cutting strips of a determined width from the sheet 22 to be cut.

If it is question of cutting another strip width, either the adjustment of the screws 61 may be directly modified in the device, or the ring 60 may be replaced by another, with pre-adjusted screws. In this latter case, each ring is in two halves adapted to be fitted on the central shaft 38, still benefitting from the angular wedging; on each face, the half-rings in question then present projecting half-bosses adapted to be covered by annular collars 62 and 63, the assembly being tightened against the star-shaped ring 48 by a nut 64 screwed on a threaded part of the central shaft 38.

The servo-control device 114 also comprises, on the side opposite the ring 60, an "umbrella" washer of which the hub 65 is pressed between two annular wedges 66, 67 and against the star-shaped ring 50 by a nut 68 screwed on a threaded part of the central shaft 38 with respect to which said hub is wedged angularly. This hub is fast with radial spring leaves 69 extending opposite all the slides 41. Each leaf occupies under tension, the position shown in solid lines and which corresponds to the "active position" of the associated slide maintaining the conjugate cutter 15 in "cutting position".

in the virtually relaxed state, the position shown in broken lines, which corresponds to the "passive position" of the associated slide enabling the conjugate cutter 15 to occupy the "retracted position".

The selector device 113 finally cooperates with a device for the neutralisable clamping of the cutters 115 (FIGS. 3 and 4).

This tightening device comprises, opposite the ring 44, as many jaws 70 and 71 as the rotor 13 presents cutters 15; similarly, it comprises, opposite the ring 45, as many jaws 72 and 73 as the rotor presents cutters. The jaws 70 and 72 are square extensions formed in projection towards each other on the arms 52 and 53 of the star-shaped rings 48 and 50 of the central shaft 38; on the other hand, the jaws 71 and 73 are square extensions in projection opposite each other on the arms 54 and 55 of the star-shaped rings 49 and 51 of the tubular shaft 46; thus, each jaw 70 and the conjugate jaw 71 are located opposite each other in order to imprison the corresponding cutter 15 and the same applies to the jaw 72 and the conjugate jaw 73 which are aligned therewith. At least one face of the jaws may be covered with a friction lining.

Of course, to obtain a clamping, the jaws of one ring must be pressed elastically against those of the other ring. To this end, and as may be seen in FIGS. 3 and 4, the conical ring 44 defines a circular groove 74 in which are housed three springs 75; each spring is interposed between the end stop 76 of a screw 77 mounted in the ring 48 of the central shaft 38 and the end stop 78 of a screw 79 mounted in the ring 49 of the tubular shaft 46. Similarly, the conical ring 45 defines a circular groove 80 in which are housed three springs 81 each interposed between the end stop of a screw 82 of the ring 50 of the central shaft 38 and the end stop of a screw 83 of the ring 51 of the tubular shaft 46. Thus, on relaxing, the springs 75 and 81 provoke a relative rotation of the shafts 38 and 46, producing an intense tightening of the jaws on the cutters.

The invention is not limited to the embodiment described and shown in detail as various modifications may be made thereto without departing from the scope thereof.

The rotary cutting device may be used when strips, laths or portions of determined width are to be cut out transversely from a sheet advancing continuously; it is more especially applicable to the cutting of laths from a sheet of wood as said latter is peeled, these laths being able to serve for the manufacture of crates, packing cases or the like; it is also applicable to the very rapid and precise cutting of leaves of veneer adapted for the manufacture of plywood.

What is claimed is:

1. Rotary cutting device comprising a rotor provided with longitudinal cutters adapted to penetrate by pressure in the sheet to be cut transversely, said device further comprising:

a squirrel cage surrounding the cutting rotor and presenting longitudinal bars which defines, in two's, slots for the passage of the cutters of this rotor, the axes of rotation of said rotor and of said cage being eccentric with respect to each other in order to effect a meshing of said cutters with said bars, by the interior, an endless belt constituted by a cutting elastomer wound around two cylinders and applied by one of its sides against the outer envelope of the edges of the cutters of the rotor, a rigid concave anvil member extending substantially concentrically with respect to the squirrel cage and disposed thereopposite with respect to the endless belt which it is intended to support during its advance, a drive device adapted to drive in rotation, indifferently, one of the belt-carrier cylinders, the cutter-carrying rotor or the squirrel cage, and a presser device tending to bring one of the squirrel cage and the anvil member closer to the other, indifferently, to grip therebetween the sheet to be cut, the distance of this anvil member to the axis of the rotor remaining constant.

2. The device of claim 1, wherein a fixed frame supports the anvil member, the belt-carrier cylinders and the cutter-carrying rotor, and a mobile chassis supporting the squirrel cage and through which said rotor passes, is guided, preferably by pivoting, relatively to the fixed frame so that the mobile equipment thus constituted forms, at least by its own gravity, the presser device which applies, via said cage, the sheet to be cut against the belt and said latter against the anvil.

3. The device of claim 2, wherein the said presser device also comprises at least one member of mechanical, pneumatic, hydraulic or like type.

4. The device of claim 1, wherein the drive device is coupled with one of the belt-carrier cylinders.

5. The device of claim 1, wherein the anvil member is adjustable in position relatively to the fixed frame.

6. The device of claim 1, wherein the rotor comprises a selector device enabling certain cutters to be retracted by bringing them closer to the axis of rotation and enabling the remaining cutters to be maintained in cutting position so as to adjust the width of the strips cut from the sheet to be cut.

7. The device of claim 6, wherein the selector device comprises as many adjusting slides as cutters, each cutter and the conjugate slide rest on one another and are guided in radial notches of the rotor, each slide presents two parallel end inclined ramps, applied against conjugate ramps of the rotor by elastic members tending to draw the corresponding cutter towards the axis of rotation, and each slide is connected to a servo-control device in longitudinal position.

8. The device of claim 7, wherein all the cutters define, at each of their ends, a slot for the passage of a retractile spring ring.

9. The device of claim 7, wherein the device controlling the slides comprises a ring made fast with the shaft of the rotor and provided with projecting fingers extending from the slides for maintaining in cutting position, each finger constituting a stop which, by cooperating with the end of the conjugate slide, opposes the translation of the ramps thereof provoking the retraction of the corresponding cutter, and this servo-control device also comprises radial spring leaves made fast, by their bases, with the shaft of the rotor and extending, by their free ends, opposite all the slides, to attempt to provoke, by abutting on said latter, the above-mentioned translation of retraction.

10. The device of claim 9, wherein it comprises as many dismountable rings with multiple fingers in different numbers as this device must cut different widths of strip from the sheet to be cut.

11. The device of claim 10, wherein each ring is in two halves connected together, on assembly, by means of at least one annular collar.

12. The device of claim 7, wherein the selector device cooperates with a device for the neutralisable clamping of the cutters.

13. The device of claim 13, wherein the clamping device comprises, opposite each inclined ramp of the slides, a conjugate conical ring, the conical ring is interposed between two star-shaped rings fast respectively with the shaft of the rotor and with a tubular shaft mounted idly thereabout, the radial arms of one star-shaped ring are offset angularly with respect to those of the other star-shaped ring so that each arm of one defines with an arm of the other the above-mentioned notch in which are guided the cutter and conjugate slide, longitudinal jaws extend, opposite each cutter, in opposite direction, on either side, which jaws are respectively fast with an arm of the first star-shaped ring and with an arm of the second star-shaped ring, and at least one spring is interposed between the star-shaped rings so that the corresponding jaws tend to press the cutters.

14. The device of claim 12, wherein at least one spring is housed in a circular groove of the conical ring and interposed between stops respectively fast with the two star-shaped rings.

15. The device of claim 1, wherein the squirrel cage comprises two end rings on which the bars are connected and fixed, each ring presents a front annular groove defined by two concentric bearing races; this groove being provided for the housing of guide rollers mounted idly and in projection on a perforated plate of the mobile chassis, and certain rollers of each plate cooperate with the inner bearing race of the conjugate groove, whilst the other rollers, intercalated between the preceding ones and more remote than these from the axis of rotation of the said cage, cooperate with the outer bearing race.

16. The device of claim 1, wherein the bars are grouped together to form two half-shells, the bars of each half-shell are connected, at their ends, by an inner notched half-collar and an outer half-collar, and the half-shells are dismountably fixed on the above-mentioned rings.

* * * * *

UNITED STATES PATENT AND TRADEMARK OFFICE

CERTIFICATE OF CORRECTION

PATENT NO. : 4,262,566

DATED : April 21, 1981

INVENTOR(S) : Jacques Fondronnier, et al

It is certified that error appears in the above-identified patent and that said Letters Patent are hereby corrected as shown below:

Column 4, line 37 - "shoulder" should be"shouldered"

Column 8, line 12, "maintianing" should be "maintaining"

Claim 13, First Line, 13 should be 12

Signed and Sealed this

*Thirtieth* Day of *June 1981*

[SEAL]

*Attest:*

RENE D. TEGTMEYER

*Attesting Officer*

*Acting Commissioner of Patents and Trademarks*